US009277848B2

(12) United States Patent
Yoon et al.

(10) Patent No.: US 9,277,848 B2
(45) Date of Patent: Mar. 8, 2016

(54) DISHWASHER

(75) Inventors: Sang Heon Yoon, Seoul (KR); Joon Ho Pyo, Seoul (KR); Jae Won Chang, Seoul (KR); Gap Su Shin, Seoul (KR)

(73) Assignee: LG Electronics Inc., Seoul (KR)

( * ) Notice: Subject to any disclaimer, the term of this patent is extended or adjusted under 35 U.S.C. 154(b) by 1342 days.

(21) Appl. No.: 12/476,902

(22) Filed: Jun. 2, 2009

(65) Prior Publication Data

US 2010/0252080 A1 Oct. 7, 2010

(30) Foreign Application Priority Data

Apr. 3, 2009 (KR) ..... 10-2009-0028929

(51) Int. Cl.
*A47L 15/42* (2006.01)

(52) U.S. Cl.
CPC ..... *A47L 15/4206* (2013.01)

(58) Field of Classification Search
CPC ..... A47L 15/4206
USPC ..... 134/110, 111
See application file for complete search history.

(56) References Cited

U.S. PATENT DOCUMENTS

| | | | | |
|---|---|---|---|---|
| 5,779,812 | A | 7/1998 | Thies et al. | |
| 2003/0205248 | A1 * | 11/2003 | Christman et al. | 134/22.18 |
| 2004/0163690 | A1 | 8/2004 | Kim | |
| 2005/0133072 | A1 | 6/2005 | Yoon et al. | |
| 2007/0215533 | A1 | 9/2007 | Tittgen | |
| 2009/0038652 | A1 | 2/2009 | Kang | |

FOREIGN PATENT DOCUMENTS

| | | | |
|---|---|---|---|
| CN | 1628597 | A | 6/2005 |
| CN | 1997431 | A | 7/2007 |
| DK | 121142 | B | 9/1971 |
| EP | 0 542 678 | A1 | 5/1993 |
| EP | 0855165 | A2 | 7/1998 |
| EP | 1380249 | A2 | 1/2004 |
| KR | 10-2004-0006153 | B1 | 1/2004 |

* cited by examiner

*Primary Examiner* — David Cormier
(74) *Attorney, Agent, or Firm* — Birch, Stewart, Kolasch & Birch, LLP

(57) ABSTRACT

A dishwasher is provided, in which a plurality of filters are modularized to extend their effective area and improve their efficiency. The dishwasher includes a tub formed at an inside of the cabinet, forming a washing space where the dishes are washed; and a sump assembly provided at a lower side of the tub and provided with a filter chamber to which a filter module is inserted. The filter module filters the washing water, and includes a plurality of drainage filters.

14 Claims, 6 Drawing Sheets

DISHWASHER

This application claims the benefit of the Korean Patent Application No. P2009-0028929, filed on Apr. 3, 2009, which is hereby incorporated by reference as if fully set forth herein.

BACKGROUND OF THE INVENTION

1. Field of the Invention

The present invention relates to a dishwasher, and a filter module of the dishwasher.

2. Discussion of the Related Art

A dishwasher is used to automatically wash and dry dishes by spraying a detergent and washing water onto the dishes. This dishwasher includes a cabinet provided with a washing chamber therein, a plurality of racks provided in the washing chamber to receive dishes, a sump assembly, and a plurality of spray arms for spraying washing water toward the dishes received in the racks. The sump assembly includes a sump for storing washing water, a pump for supplying the washing water of the sump to the spray arms, and a heater for heating the washing water.

If the pump is actuated, the spray arm washes the dishes while spraying the washing water that was stored in the sump. The washing water sprayed toward the dishes is collected in the sump and then is again sprayed toward the dishes. When the washing process is finished, a drainage pump is actuated to drain the water of the sump to the outside through a drainage hose. After the drainage pump is stopped, clean water is supplied to the sump for a rinsing process. The clean water is again sprayed to the dishes to rinse the dishes.

The dishwasher may include a filter to filter the water used for washing the dishes.

SUMMARY OF THE INVENTION

Accordingly, the present invention is directed to a dishwasher that substantially obviates one or more problems due to limitations and disadvantages of the related art.

An object of the present invention is to provide a dishwasher, in which a plurality of filters are modularized to extend their effective area and improve their filtering efficiency.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a dishwasher according to the present invention may include a cabinet constituting an external appearance; a tub formed at an inside of the cabinet, forming a washing space where the dishes are washed; and a sump assembly provided in a lower portion of the cabinet and provided with a filter chamber to which a filter module is inserted, the filter module filtering washing water, wherein the filter module includes a plurality of drainage filters.

The filter module includes the plurality of drainage filters, and a filter support member supporting the drainage filters.

The drainage filters have both ends detachably coupled to the filter support member.

The drainage filters are spaced apart from one another at predetermined intervals.

The drainage filters have cross sections of a partial cylindrical shape corresponding to a fan shape.

The drainage filters have both longitudinal ends opened to enable inflow and outflow of washing water.

The drainage filters further include a plurality of main guide ribs formed in a longitudinal direction and a plurality of sub guide ribs formed between the respective main guide ribs, to maintain the shape of the drainage filters.

The filter support member includes a lower guide supporting a lower end of the drainage filters, and an upper guide supporting an upper end of the drainage filters.

The filter support member further includes a plurality of hooks protrusively formed below the lower guide and coupled to an inner side of the filter chamber.

The filter chamber is provided with a plurality of catching protrusions at its inner side to catch the hooks therein.

The filter module further includes a sub filter member coupled to an upper side of the upper guide to filter relatively large sized particles as compared with those filtered through the drainage filters.

The sub filter member includes a filter part filtering dirt, and a sub bracket supporting the filter part.

The filter support member further includes a bracket receiver on which the sub bracket is mounted.

The filter support member further includes a plurality of guide grooves to which the sub bracket is coupled.

The sub filter member further includes a plurality of receiving protrusions inserted to the guide grooves.

The sub filter member is located at an outer side of the filter chamber.

The washing water passed through the drainage filters is connected with a drainage side and then is drained out.

The washing water passed through the drainage filters is connected with a washing water supply side to be reused for washing the dishes until the washing water is drained out.

In another aspect of the present invention, a dishwasher comprises a cabinet constituting an external appearance; a tub formed at an inside of the cabinet, forming a washing space where the dishes are washed; and a sump assembly provided at a lower portion of the cabinet and provided with a filter chamber to which a filter module is inserted, the filter module filtering washing water, wherein the filter module includes a plurality of drainage filters spaced apart from one another to extend an effective area filtering the washing water.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

The present invention relates to a dishwasher in which a plurality of filters are modularized to extend their effective area, whereby filtering efficiency is improved.

Hereinafter, a dishwasher according to one embodiment of the present invention will be described in detail with reference to the accompanying drawings.

Figure 1:
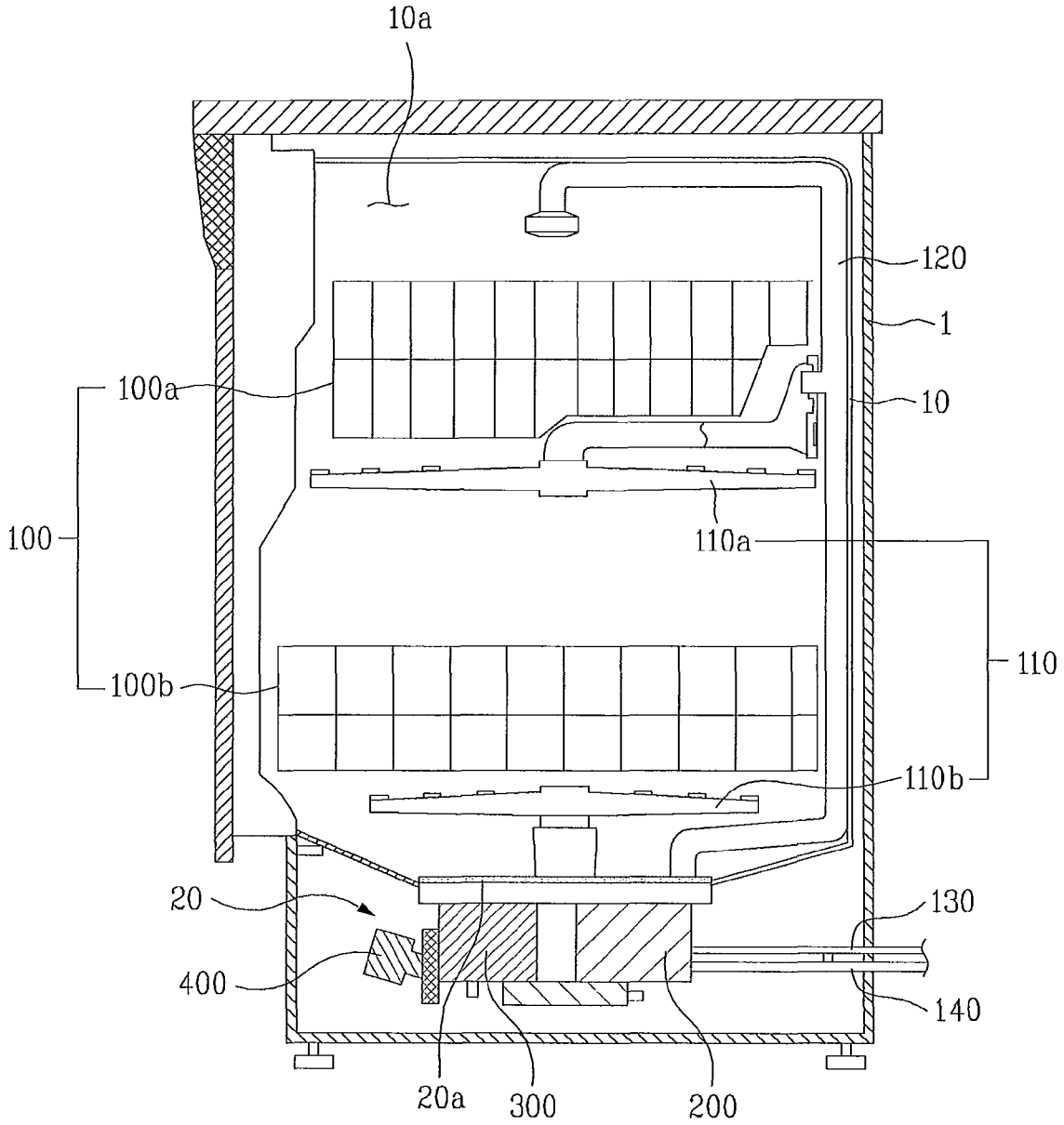
FIG. 1 is a sectional view illustrating a dishwasher according to one embodiment of the present invention.
Figure 2:
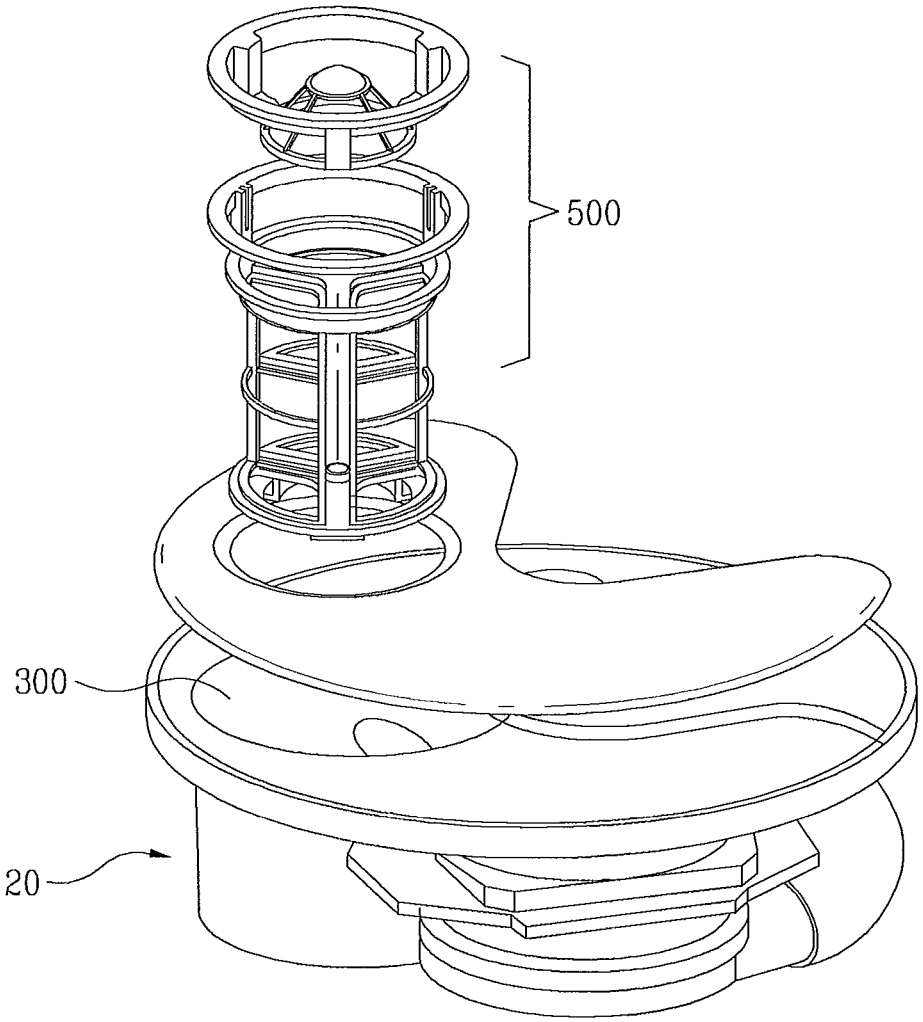
FIG. 2 is an exploded perspective view illustrating a sump assembly of FIG. 1.

As illustrated in FIG. 1, a dishwasher according to one embodiment of the present invention includes a cabinet 1 constituting an external appearance of the dishwasher, a tub 10 forming a washing space where the dishes are washed, a door opening and closing the tub 10, and a sump assembly 20 supplying and collecting washing water. It is also envisioned that the dishwasher may be produced without a cabinet, particularly for a dishwasher that is designed to be built-in under a kitchen countertop.

A washing chamber 10*a* is formed in the tub 10 to receive the dishes, and a plurality of racks 100 are provided in the washing chamber 10*a* to arrange the dishes thereon.

The racks 100 include an upper rack 100*a* and a lower rack 100*b*. Washing water is sprayed through a spray arm 110 to the dishes received in the racks 100, whereby the dishes are washed.

The spray arm 110 includes an upper arm 110*a* arranged below the upper rack 100*a*, and a lower arm 110*b* arranged below the lower rack 100*b*. The upper arm 110*a* and the lower arm 110*b* are rotatably arranged. The spray arm 110 is provided with a plurality of spray nozzles spraying washing water toward the dishes.

The sump assembly 20 is connected with the upper arm 110*a* and the lower arm 110*b* through a connection pipe 120. The sump assembly 20 is supplied with washing water from an external water supply source through a water supply pipe 130 and stores the washing water in a sump 200. The sump assembly 20 supplies the washing water to the upper arm 110*a* and the lower arm 110*b* through the connection pipe 120, selectively or simultaneously.

The sump assembly 20 includes the sump 200 for storing the washing water, a water supply pump (not shown) for pumping the water stored in the sump 200, and a guide plate (not shown) for guiding the pumped water to the upper arm 110*a* and the lower arm 110*b*. A heater (not shown) for heating the washing water is provided in the sump.

Also, the sump assembly 20 is provided with a filter chamber 300.

A filter module 500 is provided in the filter chamber 300. The filter module 500 is provided to filter dirt from the washing water used for washing the dishes, and draining out the dirt. The filter chamber 300 is connected with a drainage pump assembly 400 for draining out the washing water, and a water supply side for reuse of the washing water.

The filtered washing water is again supplied to the water supply side and is reused there until drainage is carried out. When drainage is carried out, a drainage pump side is opened so that the washing water is drained through a drainage pipe 140. The sump assembly 20 is covered by a sump cover 20*a* and then arranged below the washing chamber 10*a*, wherein the sump cover 20*a* is provided with a separate washing water filter (not shown) filtering the washing water supplied to the washing chamber 10*a*.

Hereinafter, the filter module provided in the filter chamber will be described in more detail with reference to FIG. 2 to FIG. 6.

As illustrated in FIG. 2 to FIG. 6, the filter module 500 is detachably provided in the filter chamber 300 of the sump assembly 20 and serves to filter the dirt out of the washing water.

Figure 3:
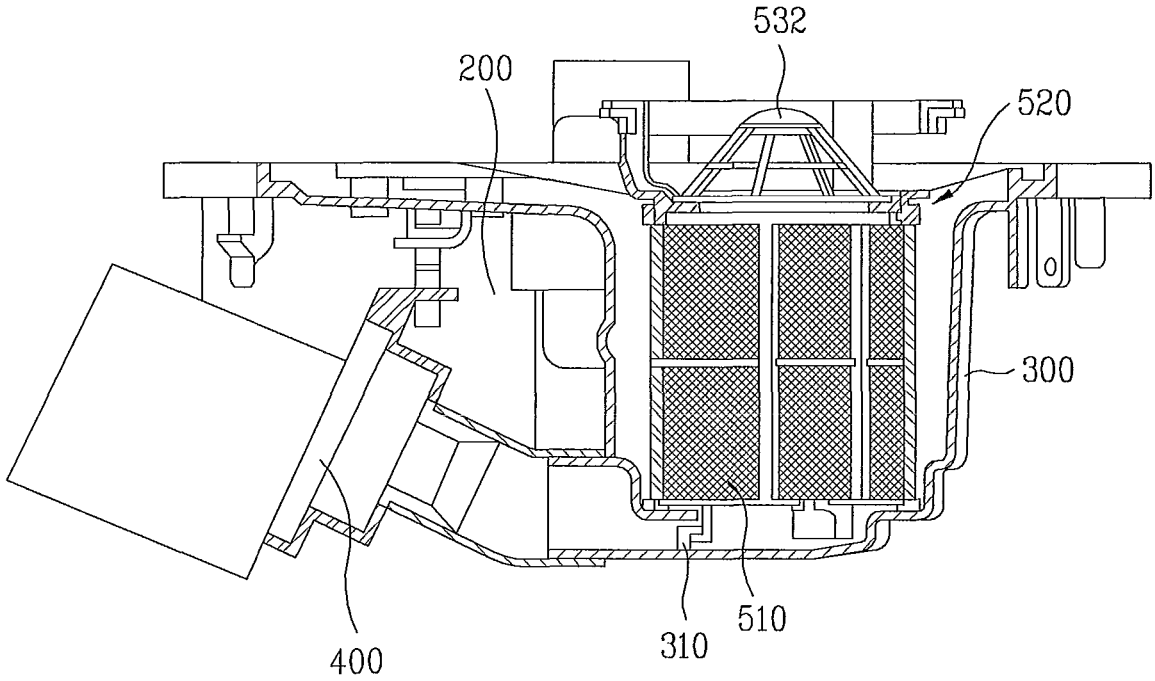
FIG. 3 is a sectional view illustrating a sump assembly of FIG. 2.

As illustrated in FIG. 3, the filter module 500 includes a drainage filter 510 for filtering dirt (food particles and the like), a filter support member 520 supporting the drainage filter 510, and a sub filter member 530 for filtering large sized dirt.

Figure 5:
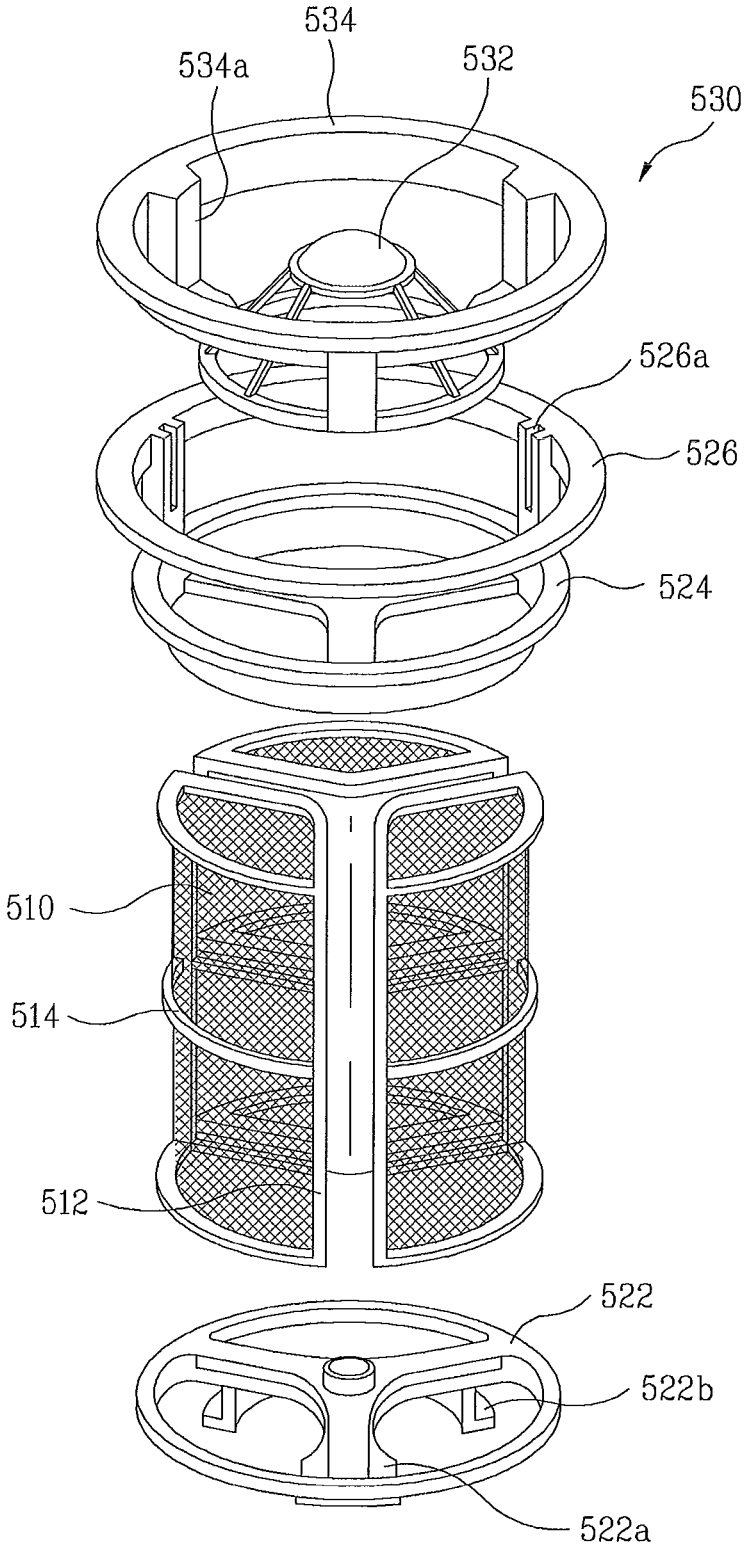
FIG. 5 is an exploded perspective view illustrating a drainage filter module of FIG. 4.

As illustrated in FIG. 5, a plurality of the drainage filters (filter elements) 510 are provided. The respective drainage filters 510 are spaced apart from each other at a predetermined distance. As compared with a drainage filter having a single cylindrical filter element, since the plurality of drainage filters 510 are used in the present invention, an effective area of the filters is extended, which is advantageous.

If the respective drainage filters are closely arranged without any space, the closely arranged plane serves as only a single filter plane, and not the plurality of respective filter planes. Accordingly, it is preferable that the respective drainage filters 510 are spaced apart from each other.

In addition to the extension of the effective filtering area, since the washing water filtered through the respective drainage filters 510 should flow for reuse or drainage, the respective drainage filters 510 are preferably spaced apart from each other.

Each of the drainage filters 510 has a cross-section of a partial cylindrical shape, i.e., a part-circle or fan shape. Each of the drainage filters 510 has both ends opened in a longitudinal direction to enable inflow and outflow of the washing water. Each of the drainage filters 510 has a plurality of main guide ribs 512 and a plurality of sub guide ribs 514 for maintaining its shape.

The main guide ribs 512 are arranged in a longitudinal direction of the drainage filters 510 to maintain the shape of the drainage filters while the sub guide ribs 514 are arranged between the respective main guide ribs 512 to maintain the shape of the drainage filters 510. Namely, the sub guide ribs 514 are formed to be perpendicular to the main guide ribs 512.

Figure 4:
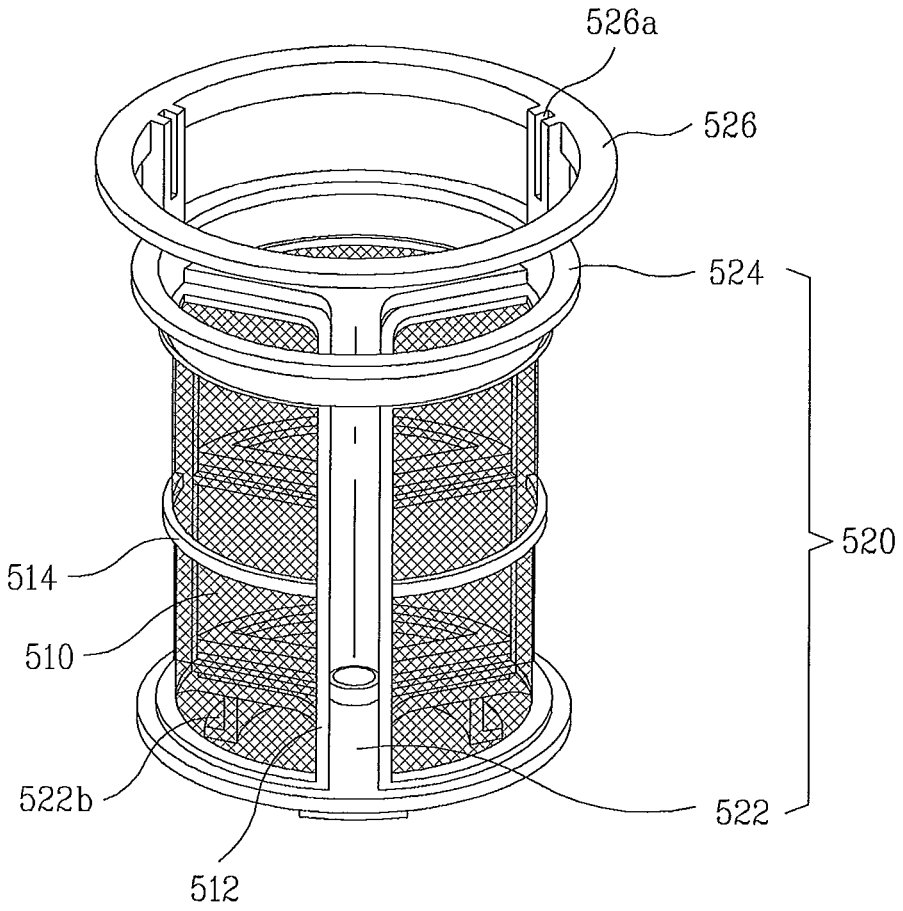
FIG. 4 is a partial exploded perspective view illustrating a drainage filter module according to the embodiment of the present invention.

As illustrated in FIG. 4, the drainage filters 510 are supported in such a manner that both of their ends are coupled to the filter support member 520. Each of the plurality of drainage filters 510 is coupled to the filter support member 520 in a state that the respective drainage filters are spaced apart from each other at a predetermined interval.

As illustrated in FIG. 5, the filter support member 520 includes a lower guide 522 supporting the lower end of the drainage filters 510, and an upper guide 524 supporting the upper end of the drainage filters 510. Also, the filter support member 520 is provided with a bracket receiver 526 in which a sub filter member 530 is mounted, wherein the sub filter member 530 will be described later.

The lower guide 522 supports the lower end of each of the drainage filters 510, and supports the drainage filters 510 along a perimeter of each of the drainage filter 510 so that the lower end of the drainage filter 510 is opened. Namely, the lower guide 522 supports the lower end of each of the drainage filters 510 by contact with the sub guide ribs 514 formed in the lower end of the drainage filter 510. Accordingly, a groove 522*a* corresponding to the shape of the lower end of each drainage filter 510 is formed on the lower guide 522.

Also, a plurality of hooks 522*b* for being coupled to the filter chamber 300 are protrusively formed below the lower guide 522. A plurality of catching protrusions 310 are formed at an inner side of the filter chamber 300 to correspond to the hooks 522*b*. In a state that the drainage filters 510 are coupled to the filter support member 520, if the filter support member is rotated after being inserted to the filter chamber 300, the hooks 522*b* are located at inner sides of the catching protrusions 310 and at the same time the filter support member 520 is coupled to the filter chamber 300 (see FIG. 3).

The upper guide 524 supports the upper end of each of the drainage filters 510, and supports the drainage filters along the perimeter of each of the drainage filter 510 so that the upper end of the drainage filter 510 is opened. Namely, the upper guide 524 supports the upper end of each of the drainage filters 510 by contact with the sub guide ribs 514 formed in the upper end of the drainage filter 510. Accordingly, a groove (not shown) corresponding to the shape of the upper end of each drainage filter 510 is formed on the upper guide 524.

Meanwhile, as illustrated in FIG. 4, a bracket receiver 526, to which a sub bracket 534 of a sub filter member 530 will be coupled, is formed above the upper guide 524.

The bracket receiver 526 is formed in a circular ring shape. In a state that the filter support member 520 is provided in the filter chamber 300, the bracket receiver 526 is exposed to the upper part of the filter chamber 300. A plurality of guide grooves 526*a* for coupling the sub filter member 530 are formed in the bracket receiver 526.

As illustrated in FIG. 5, the guide grooves 526*a* extend between the upper part of the bracket receiver 526 to the upper part of the upper guide 524. Accordingly, the bracket receiver 526 is spaced apart from the upper guide 524 at a predetermined interval by interposing the guide grooves 526*a* therebetween. Accordingly, the bracket receiver 526 forms a space where the sub filter member 530 will be inserted together with the upper guide 524.

The sub filter member 530 is provided to primarily filter relatively large sized particles as compared with those filtered through the drainage filter 510. The sub filter member 530 includes a filter part 532 and a sub bracket 534 supporting the filter part 532.

The sub filter member 530 is provided to prevent filtering efficiency from being deteriorated as large sized food residue flows to the drainage filter 510. Accordingly, if the sub filter member 530 is provided, if the food residue is stacked in the sub filter member 530 at a certain level, inconvenience occurs in that the user should clean the sub filter member 530. However, since the drainage filter 510 can be prevented from being clogged with the food residue, it is advantageous in that filtering efficiency can be improved.

The filter part 532 has a cone shape, and includes a plurality of ribs spaced apart from one another at predetermined intervals. The filter member 532 is connected with the sub bracket 534 coupled to the aforementioned bracket receiver 526, and the sub bracket 534 and the filter part 532 are connected with each other by a plurality of receiving protrusions 534*a*.

Since the sub bracket 534 is inserted to the inner side of the bracket receiver 526, it is preferable that an outer diameter of the sub bracket 534 corresponds to an inner diameter of the bracket receiver 526. Also, it is preferable that the sub bracket 534 and the bracket receiver 526 are formed to correspond to each other, so as to form one module when the sub bracket 534 is coupled to the bracket receiver 526.

Figure 6:
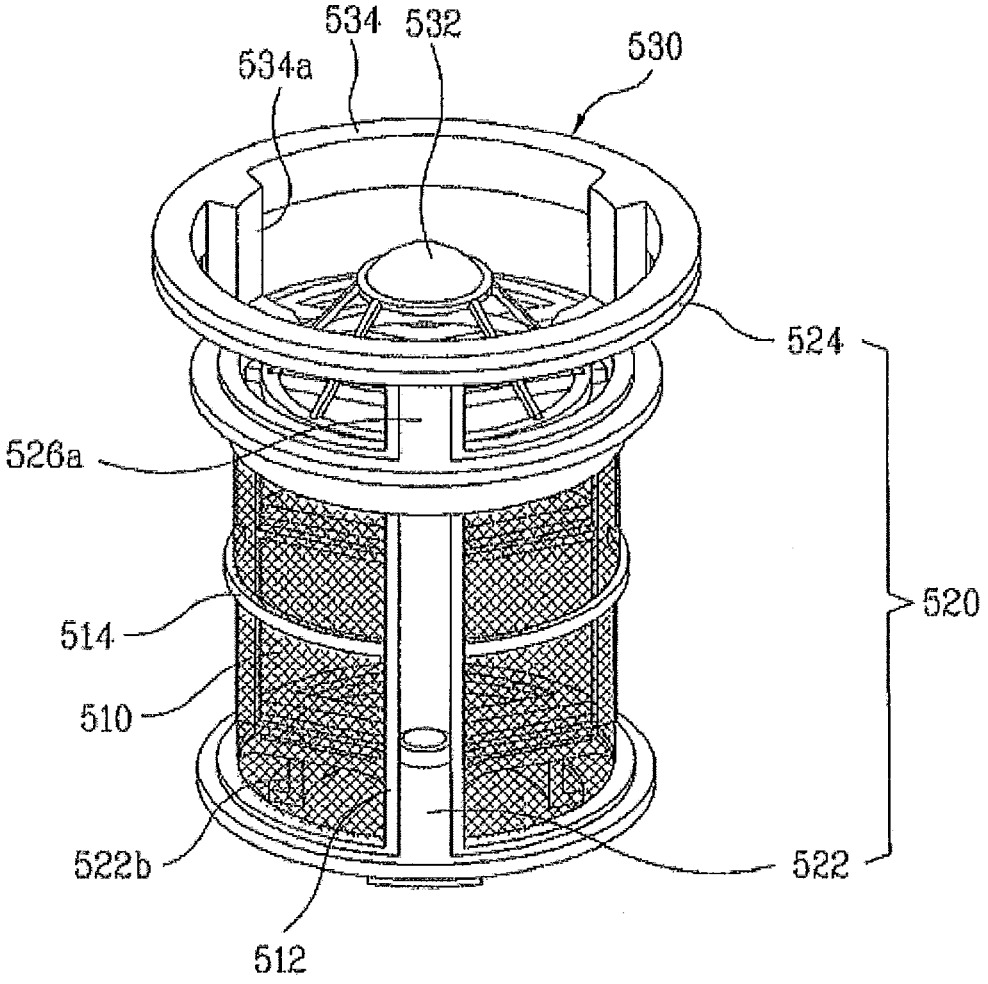
FIG. 6 is a perspective view illustrating a completely assembled drainage filter module of FIG. 4.

Accordingly, as illustrated in FIG. 6, if the receiving protrusions 534*a* of the sub filter member 530 are inserted to the guide grooves 526*a* of the bracket receiver 526, the sub filter member 530 is closely coupled to the inner side of the bracket receiver 526 to constitute one module.

Furthermore, as illustrated in FIG. 3, since the bracket receiver 526 is exposed to the outside of the filter chamber 300, the sub filter member 530 is also exposed to the outside of the filter chamber 300.

A flow of the washing water through the filter module in the dishwasher according to one embodiment of the present invention will be described below.

As illustrated in FIG. 3, one side at the lower part of the filter chamber 300 is connected with a drainage pump assembly 400. Accordingly, since the drainage filter 510 is connected with the drainage side, the washing water of which dirt is filtered through the drainage filter 510 can be drained to the outside of the dishwasher through the drainage pump assembly 400.

At this time, the washing water flows into the opened upper end of the drainage filter 510 and is drained out through the side of the drainage filter 510, and the dirt remains at the inner side of the drainage filter 510.

However, since the lower end of the filter chamber 300 is closed before the drainage pump assembly 400 is operated, the washing water passed through the drainage filter 510 is connected with the water supply side, whereby the washing water can be reused for washing the dishes through the water supply pump (not shown).

As described above, the dishwasher according to the embodiment of the present invention has several advantages.

Because a plurality of drainage filters are modularized, an effective area of the filters filtering the dirt can be increased. As a result, filtering efficiency can be improved.

It will be apparent to those skilled in the art that the present invention can be embodied in other specific forms without departing from the spirit and essential characteristics of the invention. Thus, the above embodiments are to be considered in all respects as illustrative and not restrictive. The scope of the invention should be determined by reasonable interpretation of the appended claims and all change which comes within the equivalent scope of the invention are included in the scope of the invention.

What is claimed is:

1. A dishwasher comprising:

a tub providing a washing space where dishes are washed;

a sump assembly provided at a lower portion of the tub; and a filter module configured to filter washing water, the filter module including a plurality of filter elements, each of the filter elements being located beside one another, wherein each of the filter elements is a columnar shape which has a sector-shaped cross-section and the plurality of filter elements together forming a cylindrical filter assembly, wherein each of the filter elements includes:

a first end portion;

a second end portion;

an exterior sidewall including a filtering material extending between the first end portion and the second end portion, which is an arcuate surface including a circumference of the filter assembly; and an interior sidewall including a filtering material, the interior sidewall extending from the exterior sidewall and between the first end portion and the second end portion, which is a surface including a radius of the cylindrical filter assembly.

2. The dishwasher of claim 1, wherein each of the filter elements are spaced apart from one another about a perimeter of the filter module.

3. The dishwasher of claim 1, wherein one side of one of the filter elements faces a side of an adjacent filter element.

4. The dishwasher of claim 1, wherein each of the first end portions comprises an opening without filtering material.

5. The dishwasher of claim 4, wherein each of the second end portions comprises an opening without filtering material.

6. The dishwasher of claim 1, wherein the filter module includes a first filter support member supporting the first end portions of the filter elements, and a second filter support member supporting the second end portions of the filter elements.

7. The dishwasher of claim 1, wherein each of the filter elements further includes a plurality of main guide ribs extending in a longitudinal direction between the first end portion and the second end portion, and a plurality of sub guide ribs extending between the main guide ribs.

8. The dishwasher of claim 6, wherein the sump assembly includes a filter chamber, the filter chamber including a plurality of catching protrusions, and wherein the first filter support member includes a plurality of hooks selectively couplable with the plurality of catching protrusions to secure the filter module to the filter chamber.

9. The dishwasher of claim 6, wherein the filter module further includes a sub filter member coupled to the second filter support member, the sub filter being configured to filter relatively larger sized particles as compared with those filtered through the plurality of filter elements.

10. The dishwasher of claim 9, wherein the sub filter member includes a filter part and a sub bracket supporting the filter part, and wherein the second filter support member further includes a bracket receiver on which the sub bracket is mounted.

11. The dishwasher of claim 10, wherein the second filter support member further includes a plurality of guide grooves to which the sub bracket is coupled, and wherein the sub filter member further includes a plurality of protrusions inserted to the guide grooves.

12. The dishwasher of claim 1, wherein each of the interior sidewalls of each filter element extends from a center of the filter module toward the exterior sidewall of the filter element.

13. The dishwasher of claim 12, wherein each of the first end portions comprises an opening without filtering material, wherein each of the second end portions comprises an opening without filtering material, wherein the interior sidewalls of the filter elements face the interior sidewalls of adjacent ones of the filter elements, and wherein the interior sidewalls are spaced apart from one another with a predetermined gap therebetween.

14. The dishwasher of claim 1, wherein the filter module is configured to permit washing water to pass generally freely through both the first and second end portions of the filter elements, and be filtered through both the exterior and interior sidewalls of the filter elements.

* * * * *